US010004935B2

(12) United States Patent
Giannelli et al.

(10) Patent No.: US 10,004,935 B2
(45) **Date of Patent: *Jun. 26, 2018**

(54) PULL DOWN EXERCISE APPARATUS

(71) Applicant: Cybex International, Inc., Medway, MA (US)

(72) Inventors: Raymond Giannelli, Franklin, MA (US); Mark Buontempo, Millville, MA (US)

(73) Assignee: Cybex International, Inc., Medway, MA (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/654,767

(22) Filed: Jul. 20, 2017

(65) Prior Publication Data

US 2017/0312565 A1 Nov. 2, 2017

Related U.S. Application Data

(63) Continuation of application No. 14/989,145, filed on Jan. 6, 2016, which is a continuation of application No. PCT/US2015/019841, filed on Mar. 11, 2015.

(Continued)

(51) Int. Cl.
*A63B 21/00* (2006.01)
*A63B 21/005* (2006.01)

(Continued)

(52) U.S. Cl.
CPC ..... *A63B 21/078* (2013.01); *A63B 21/00065* (2013.01); *A63B 21/00076* (2013.01);

(Continued)

(58) Field of Classification Search
CPC . A63B 21/062–21/0632; A63B 21/159; A63B 23/1209–23/1218; A63B 23/0233
See application file for complete search history.

(56) References Cited

U.S. PATENT DOCUMENTS 4,842,266 A 6/1989 Sweeney, Sr. et al.
5,114,388 A 5/1992 Trulaske (Continued)

FOREIGN PATENT DOCUMENTS

JP 3183390 5/2013
KR 10-0834880 5/2008

(Continued)

OTHER PUBLICATIONS

Int'l. Search Report and Written Opinion dated Feb. 4, 2015 in Int'l. Appln. No. PCT/US2014/055124.

(Continued)

*Primary Examiner* — Loan H Thanh
*Assistant Examiner* — Jennifer M Deichl
(74) *Attorney, Agent, or Firm* — Polsinelli PC; M. Lawrence Oliverio

(57) ABSTRACT

Apparatus for performing a pull down exercise comprising:
a frame,
a seat,
an input arm assembly interconnected to a resistance mechanism and a manually graspable mechanism disposed vertically above the user's trunk in a start sitting exercise position, the input arm assembly being pivotably mounted on the frame for back and forth travel along a generally forward to rearward direction and along a generally side to side direction orthogonal to the forward to rearward direction,
the input arm assembly being rotatably pivotable around a first linear axis and a second linear axis in the respective directions on exertion by the user of a rearwardly downwardly directed force on the manually graspable mechanism.

21 Claims, 12 Drawing Sheets

Related U.S. Application Data

(60) Provisional application No. 61/951,011, filed on Mar. 11, 2014, provisional application No. 61/951,059, filed on Mar. 11, 2014, provisional application No. 61/951,026, filed on Mar. 11, 2014, provisional application No. 61/951,034, filed on Mar. 11, 2014, provisional application No. 61/951,046, filed on Mar. 11, 2014.

(51) Int. Cl.

| | |
|---|---|
| ***A63B 21/008*** | (2006.01) |
| ***A63B 21/012*** | (2006.01) |
| ***A63B 21/02*** | (2006.01) |
| ***A63B 21/04*** | (2006.01) |
| ***A63B 21/055*** | (2006.01) |
| ***A63B 21/062*** | (2006.01) |
| ***A63B 21/078*** | (2006.01) |
| ***A63B 23/02*** | (2006.01) |
| ***A63B 23/035*** | (2006.01) |
| ***A63B 23/12*** | (2006.01) |

(52) U.S. Cl.

CPC ..... *A63B 21/0083* (2013.01); *A63B 21/0087* (2013.01); *A63B 21/0407* (2013.01); *A63B 21/062* (2013.01); *A63B 21/063* (2015.10); *A63B 21/0628* (2015.10); *A63B 21/152* (2013.01); *A63B 21/154* (2013.01); *A63B 21/159* (2013.01); *A63B 21/4035* (2015.10); *A63B 21/4047* (2015.10); *A63B 23/0205* (2013.01); *A63B 23/0211* (2013.01); *A63B 23/0233* (2013.01); *A63B 23/035* (2013.01); *A63B 23/03525* (2013.01); *A63B 23/1209* (2013.01); *A63B 23/1281* (2013.01); *A63B 21/005* (2013.01); *A63B 21/0088* (2013.01); *A63B 21/012* (2013.01); *A63B 21/023* (2013.01); *A63B 21/0552* (2013.01); *A63B 2208/0228* (2013.01); *A63B 2208/0233* (2013.01); *A63B 2208/0238* (2013.01)

(56) References Cited

U.S. PATENT DOCUMENTS

| | | | | |
|---|---|---|---|---|
| 5,254,066 | A | 10/1993 | Brown et al. | |
| 5,597,375 | A * | 1/1997 | Simonson ..... | A63B 23/1254 482/100 |
| 6,302,833 | B1 * | 10/2001 | Ellis ..... | A63B 21/078 482/100 |
| 8,025,609 | B2 | 9/2011 | Giannelli et al. | |
| 2003/0158019 | A1 * | 8/2003 | Giannelli ..... | A63B 21/155 482/100 |
| 2010/0000981 | A1 | 1/2010 | Simonson et al. | |
| 2010/0190617 | A1 | 7/2010 | Gautier | |
| 2012/0032262 | A1 | 12/2012 | Bingham, Jr. et al. | |

FOREIGN PATENT DOCUMENTS

| | | | |
|---|---|---|---|
| WO | 96/26466 | A1 | 9/1996 |
| WO | 2008017049 | A2 | 2/2008 |

OTHER PUBLICATIONS

Extended Search Report dated May 4, 2017 in European Appln. No. 16203310.4-1658.

Int'l. Search Report and Written Opinion from priority application PCT/US2015/019841.

* cited by examiner

PULL DOWN EXERCISE APPARATUS

RELATED APPLICATIONS

This application is a continuation of U.S. application Ser. No. 14/989,145 filed Jan. 6, 2016 which is a continuation of PCT/US2015/019841 filed Mar. 11, 2015 which claims the benefit of priority to U.S. Provisional Application No. 61/951,011 filed Mar. 11, 2014 and U.S. Provisional Application No. 61/951,059 filed Mar. 11, 2014 and U.S. Provisional Application No. 61/951,026 filed Mar. 11, 2014 and U.S. Provisional Application No. 61/951,034 filed Mar. 11, 2014 and U.S. Provisional Application No. 61/951,046 filed Mar. 11, 2014 the disclosures of all of which are incorporated herein by reference in their entirety as if fully set forth herein.

This application incorporates by reference the disclosures of all of the following in their entirety as if fully set forth herein: U.S. Pat. No. 7,666,123, U.S. Pat. No. 7,717,831, U.S. Pat. No. 4,725,054, U.S. Pat. No. 8,070,658, U.S. Pat. No. 7,278,955, U.S. Pat. No. 8,025,609, U.S. Pat. No. 7,727,128, U.S. Pat. No. D486,535, U.S. Pat. No. D490,127, U.S. Patent Publication No. 2003/0092541, U.S. Patent Publication No. 2007/0173384, U.S. Patent Publication No. 2006/0270531, U.S. Patent Publication No. 2008/0167169, U.S. Patent Publication No. 2010/0204021.

FIELD OF THE INVENTION

The present invention relates to physical exercise machines and more particularly to an exercise apparatus that enables users to perform pull down exercise that is resisted by a resistance mechanism.

BACKGROUND OF THE INVENTION

Exercise machines for exercising latissimus dorsi muscles are known and used for directing movement of a user upper torso by forcing the user to use the user's lattisimus dorsi muscles against a weight resistance. It normally requires either three separate machines or at the very least, different accessory handles that would have to be switched to gain access to each configuration in order to fully exercise a user's lattisimus dorsi.

SUMMARY OF THE INVENTION

The present invention employs a system where the user can accomplish all three training methods in one machine without any separate adjustments or accessory handle changes to move between each pattern. By utilization of a dual axis arm configuration which allows for horizontal movement of the input grips as well as vertical movement of the arms, these three movements can be accomplished just by grabbing a different grip. Since each arm has three separate grips that are always attached, this requires no setup or modification. By grabbing the outermost horizontal grips, the user is pulling both down and toward their midline. Since the secondary axis is blocked from moving toward the user midline and the primary axis is horizontal to the ground, the arm moves in a substantially vertical direction very similar to a cable based straight lat bar. In the second exercise, the user grabs the grips that are oriented forward of the users frontal plane, point away from the user and are approximately one foot apart which would be identified as a close grip handle configuration. Due to the fact that the users arms are forward of their frontal plane, it encourages a range of motion that has no horizontal component and is substantially vertical. The last exercise is accomplished with the user grabbing the inner most horizontal grip. In this exercise, the users arms elbows are facing outward which encourages a divergent path of motion moving both down and away from the users midline. Since the arms secondary axis allows movement away from the midline, the divergent path is accomplished with ease. Since the resistive load is attached directly to the arm, any horizontal motion is accompanied by a significant vertical load in addition to a slight horizontal resistive component.

In accordance with the invention there is provided an apparatus 10 for performing a pull down exercise by a user 5 having a trunk T1 having a longitudinal axis LA, opposing anterior AS and posterior PS sides and arms extending from the trunk, the apparatus comprising:

a frame 12, a seat 16 having a seating surface S, an input arm assembly (24) interconnected to a resistance mechanism (42) and a manually graspable mechanism (30*h*), the input arm assembly being pivotably (AA, Z) mounted on the frame for back and forth travel along a generally forward (FW) to rearward (RW) direction, the input arm assembly being adapted to reside in a start motionless position (SMP) that disposes the manually graspable mechanism (30*h*) in a start exercise position (SEP) that is disposed vertically (V) above the user's trunk (T1) when the user is seated on the seating surface (S) in an orientation where the longitudinal axis (LA) of the user's trunk (T1) is disposed generally upright (V), the input arm assembly being rotatably pivotable (RDA) around a first linear axis (AA) starting from the start motionless position (SMP) through a generally rearward (RW) and downward (DW) path of travel under resistance (R1) exerted by the resistance mechanism (42) on application of rearwardly or downwardly directed force (RDF) by the user on the manually graspable mechanism (30*h*), the input arm assembly being rotatably pivotable SS around a second linear axis Z through a generally lateral LAT or side to side path of travel under resistance R1*a* exerted by the resistance mechanism 42 on application of generally laterally directed force LF by the user on the manually graspable mechanism 30*h* starting from the start exercise position SEP.

The seat (16) and the input arm assembly (24) are typically arranged and adapted to enable the user (5) in a user standing position (USP) to manually engage (ME) the manually graspable mechanism (30*h*) with the input arm assembly in the start motionless position (SMP) and to manually pull (RDF) the manually graspable mechanism (30*h*) downwardly (DW) under user exerted force (RDF) to a start sitting exercise position (SSEP) where the user is sitting in a seated position (SP) on the seat surface (S) and manually engaging (ME) the manually graspable mechanism (30*h*), The input arm assembly is typically interconnected to the resistance mechanism 42 at a point of interconnection 30*de* of the input arm assembly that is spaced a first selected orthogonal distance FOD apart from the first linear axis selected to create a first selected torque resistance FTR from the resistance mechanism 42 when the input arm assembly is pivoted away from the start motionless position SMP and a second selected orthogonal distance SOD from the second linear axis selected to create a second selected torque resistance STR from the resistance mechanism 42 when the input arm assembly is pivoted away from the start motionless position SMP.

The first selected orthogonal distance FOD is preferably greater than the second selected orthogonal distance SOD. The first selected orthogonal distance FOD is preferably greater than or equal to about 6 inches and the second selected orthogonal distance SOD is greater than or equal to about 3 inches.

The first linear axis and second linear axis can be disposed generally orthogonal relative to each other.

The input arm assembly can be interconnected to the resistance mechanism via a cable that is interconnected at a proximal end to a point of interconnection of the input arm assembly that is spaced a first selected orthogonal distance apart from the first linear axis selected to create a first selected torque resistance from the resistance mechanism and a second selected orthogonal distance from the second linear axis selected to create a second selected torque resistance from the resistance mechanism wherein a distal end of the cable is interconnected to the resistance mechanism.

The resistance mechanism can comprise a selectable fixed weight device or a device that increases degree of resistance against the user's application of force on increase in pivotable movement of the input arm assembly rearwardly away from the start motionless position.

The seat is preferably selectively adjustable 100 in vertical position relative to the manually graspable mechanism.

The apparatus can further comprise a stabilization pad mounted in a fixed position relative to the seat that is adapted to engage an anterior surface of the user's legs when the user is seated on the seat in an orientation where the longitudinal axis of the user's trunk is disposed generally upright and the anterior and posterior sides of the user's trunk are oriented generally in the forward to rearward direction.

The input arm assembly can comprise an arm interconnected to a first axle that pivots about the first linear axis, the first axle being fixedly interconnected to a second axle that pivots about the second linear axis.

The first axle is preferably adapted to rotate around the first linear axis and the second axle is non-rotatable around the second linear axis, the first and second axles being pivotably mounted to first and second brackets forming a gimbal assembly.

In another aspect of the invention there is provided a method of performing a pull down exercise comprising:

a user being seated on the seat of the exercise apparatus described immediately above in a disposition where the longitudinal axis of the user's trunk is disposed generally upright and the anterior and posterior sides of the user's trunk are oriented generally in the forward to rearward direction, the user manually engaging the manually graspable mechanism, and the user applying a rearwardly or downwardly directed force on the manually graspable mechanism against resistance from the resistance mechanism.

In another aspect of the invention there is provided a method of performing a pull down exercise comprising:

a user being seated on the seat of the exercise apparatus described above in a disposition where the longitudinal axis of the user's trunk is disposed generally upright and the anterior and posterior sides of the user's trunk are oriented generally in the forward to rearward direction, the user manually engaging the manually graspable mechanism of the apparatus, and the user applying a laterally or side to side directed force on the manually graspable mechanism against resistance from the resistance mechanism.

In another aspect of the invention there is provided an apparatus for performing a pull down exercise by a user having a trunk having a longitudinal axis, opposing anterior and posterior sides and arms extending from the trunk, the apparatus comprising:

a frame, a seat having a seating surface (PS), an input arm assembly interconnected to a resistance mechanism and a manually graspable mechanism, the input arm assembly being pivotably mounted on the frame for back and forth travel along a generally forward to rearward direction, the input arm assembly being adapted to reside in a start motionless position (SMP) that disposes the manually graspable mechanism (30*h*) in a start exercise position (SEP) that is disposed vertically above the user's trunk (T1) when the user is seated (SP) on the seating surface (S) where the longitudinal axis (LA) of the user's trunk is disposed generally upright (V), the input arm assembly being rotatably pivotable around a first linear axis (AA) starting from the start motionless position (SMP) through a generally rearward or downward path of travel under exertion of rearwardly or downwardly directed force RDF by the user on the manually graspable mechanism 30*h*, the input arm assembly being rotatably pivotable around a second linear axis Z through a generally lateral or side to side SS path of travel that is generally orthogonal to the rearward downward path of travel under resistance (R1*a*) from the resistance mechanism (42), the input arm assembly being interconnected to the resistance mechanism (42) at a point of interconnection (30*de*) of the input arm assembly that is spaced a first selected orthogonal distance (FOD) apart from the first linear axis (AA) selected to create a first selected torque resistance from the resistance mechanism (42) on pivoting of the input arm assembly around the first linear axis, the point of interconnection (30*de*) of the input arm assembly being spaced a second selected orthogonal distance (SOD) from the second linear axis selected to create a second selected torque resistance from the resistance mechanism (42) on pivoting of the input arm assembly around the second linear axis (Z).

The first selected orthogonal distance is preferably greater than the second selected orthogonal distance.

The first selected orthogonal distance is typically greater than or equal to about 9 inches and the second selected orthogonal distance is greater than or equal to about 3 inches.

The first linear axis and second linear axis can be disposed generally orthogonal relative to each other.

The input arm assembly is preferably interconnected to the resistance mechanism via a cable that is interconnected at a proximal end to a point of interconnection of the input arm assembly that is spaced a first selected orthogonal distance apart from the first linear axis selected to create a first selected torque resistance from the resistance mechanism and a second selected orthogonal distance from the second linear axis selected to create a second selected torque resistance from the resistance mechanism wherein a distal end of the cable is interconnected to the resistance mechanism.

The resistance mechanism can comprise a selectable fixed weight device or a device that increases degree of resistance against the user's application of force on increase in pivotable movement of the input arm assembly rearwardly away from the start motionless position.

The seat is preferably selectively adjustable in vertical position relative to the manually graspable mechanism.

Such an apparatus can further comprise a stabilization pad mounted in a fixed position relative to the seat that is adapted to engage an anterior surface of the user's legs when the user is seated on the seat in an orientation where the longitudinal axis of the user's trunk is disposed generally upright and the anterior and posterior sides of the user's trunk are oriented generally in the forward to rearward direction.

The input arm assembly can comprise an arm interconnected to a first axle that pivots about the first linear axis, the first axle being fixedly interconnected to a second axle that pivots about the second linear axis.

The first axle is preferably adapted to rotate around the first linear axis and the second axle is non-rotatable around the second linear axis, the first and second axles being pivotably mounted to first and second brackets forming a gimbal assembly.

In another aspect of the invention there is provided a method of performing a pull down exercise comprising:

a user being seated on the seat of the exercise apparatus described immediately above in a disposition where the longitudinal axis of the user's trunk is disposed generally upright and the anterior and posterior sides of the user's trunk are oriented generally in the forward to rearward direction, the user manually engaging the manually graspable mechanism of the apparatus, and the user applying rearwardly and downwardly directed force on the manually graspable mechanism against resistance from the resistance mechanism.

In another aspect of the invention there is provided a method of performing a pull down exercise comprising:

a user being seated on the seat of the exercise apparatus described above in a disposition where the longitudinal axis of the user's trunk is disposed generally upright and the anterior and posterior sides of the user's trunk are oriented generally in the forward to rearward direction, the user manually engaging the manually graspable mechanism of the apparatus, and the user applying a laterally or side to side directed force on the manually graspable mechanism against resistance from the resistance mechanism.

In another aspect of the invention there is provided an apparatus 10 for performing a pull down exercise by a user 5 having a trunk T1 having a longitudinal axis LA, opposing anterior AS and posterior PS sides, the user having arms extending from the trunk, the apparatus comprising:

a frame 12, a seat 16 having a seating surface S, an input arm assembly 24 interconnected to a resistance mechanism 42 and a manually graspable mechanism 30*h*, the input arm assembly being pivotably AA, Z mounted on the frame for back and forth travel along a generally forward FW to rearward RW direction, the input arm assembly being adapted to reside in a start motionless position SMP that disposes the manually graspable mechanism 30*h* in a start exercise position SEP that is disposed vertically V above the user's trunk T1 when the user is seated SP on the seating surface S in an orientation where the longitudinal axis LA of the user's trunk T1 is disposed generally upright V, the seat 16 being arranged relative to the input arm assembly 24 to position the user 5 in a user start position USP that enables the user to manually engage ME the manually graspable mechanism 30*h* when the user is seated in an orientation where the longitudinal axis LA of the user's trunk T1 is disposed generally upright V and the anterior AS and posterior PS sides of the user's trunk T1 are oriented generally in the forward FW to rearward RW direction, the input arm assembly being rotatably pivotable RDA around a first linear axis AA starting from the start exercise position SEP through a generally rearward RW and downward DW path of travel under resistance R1 exerted by the resistance mechanism 42 on application of rearwardly or downwardly directed force RDF by the user on the manually graspable mechanism 30*h*, the input arm assembly being rotatably pivotable SS around a second linear axis Z through a generally lateral LAT or side to side path of travel on application of generally laterally directed force LF by the user on the manually graspable mechanism 30*h* starting from the start exercise position SEP, the manually graspable mechanism 30*h* including at least two travel directors 30*hi*, 30*hs*, 30*ho* that are each separately manually graspable by the user in a physical posture that is unique to each travel director, each travel director being interconnected to the input arm assembly in an arrangement that directs side to side or lateral travel of the manually graspable mechanism on application of rearwardly or downwardly directed force by the user along a lateral path of travel that is different for and unique to each travel director.

In such an apparatus the manually graspable mechanism can include two or more of a first travel director 30*ho* that directs lateral travel of the manually graspable mechanism along a lateral path of travel laterally outwardly away from a midline MID of the apparatus, a second travel director 30*hs* that directs lateral travel of the manually graspable mechanism along a lateral path of travel generally parallel to the midline MID and a third travel director 30*hi* that directs the manually graspable mechanism along a lateral path of travel laterally inwardly toward the midline MID.

In another aspect of the invention there is provided a method of performing a pull down exercise comprising:

a user being seated on the seat of the exercise apparatus described above in a disposition where the longitudinal axis of the user's trunk is disposed generally upright and the anterior and posterior sides of the user's trunk are oriented generally in the forward to rearward direction, the user manually engaging one of the travel directors and, the user applying rearwardly and downwardly directed force on the manually graspable mechanism against resistance from the resistance mechanism.

In accordance with the invention there is provided an apparatus for performing a pull down exercise by a user, the apparatus comprising:

a frame, a seat mounted on the frame in a position relative to the ground such that a user can sit on the seat with the user's feet touching the ground, an input arm assembly having a pair of arms having manually engageable grips or handles, the arms being mounted, arranged and adapted such that the grips or handles are disposed above the user's head within arms-length reach of the user's hands, the arms being interconnected to a manually selectively adjustable weight resistance mechanism, the arms being adapted, mounted and arranged on the frame for being rotatably pivotable around a first linear axis by the user's pulling downwardly on the grips or handles, the arms being further adapted, mounted and arranged on the frame for being rotatably pivotable around a second linear axis by the user's pulling or pushing laterally or sideways on the grips or handles, the seat being mounted, arranged and adapted to position the user in a position while sitting on the seat such that user can readily engage the grips or handles.

The first and second linear axes are typically generally orthogonal or perpendicular to each other.

BRIEF DESCRIPTION OF THE DRAWINGS

The above and further advantages of the invention may be better understood by referring to the following description in conjunction with the accompanying drawings in which.

DETAILED DESCRIPTION

Figure 1:
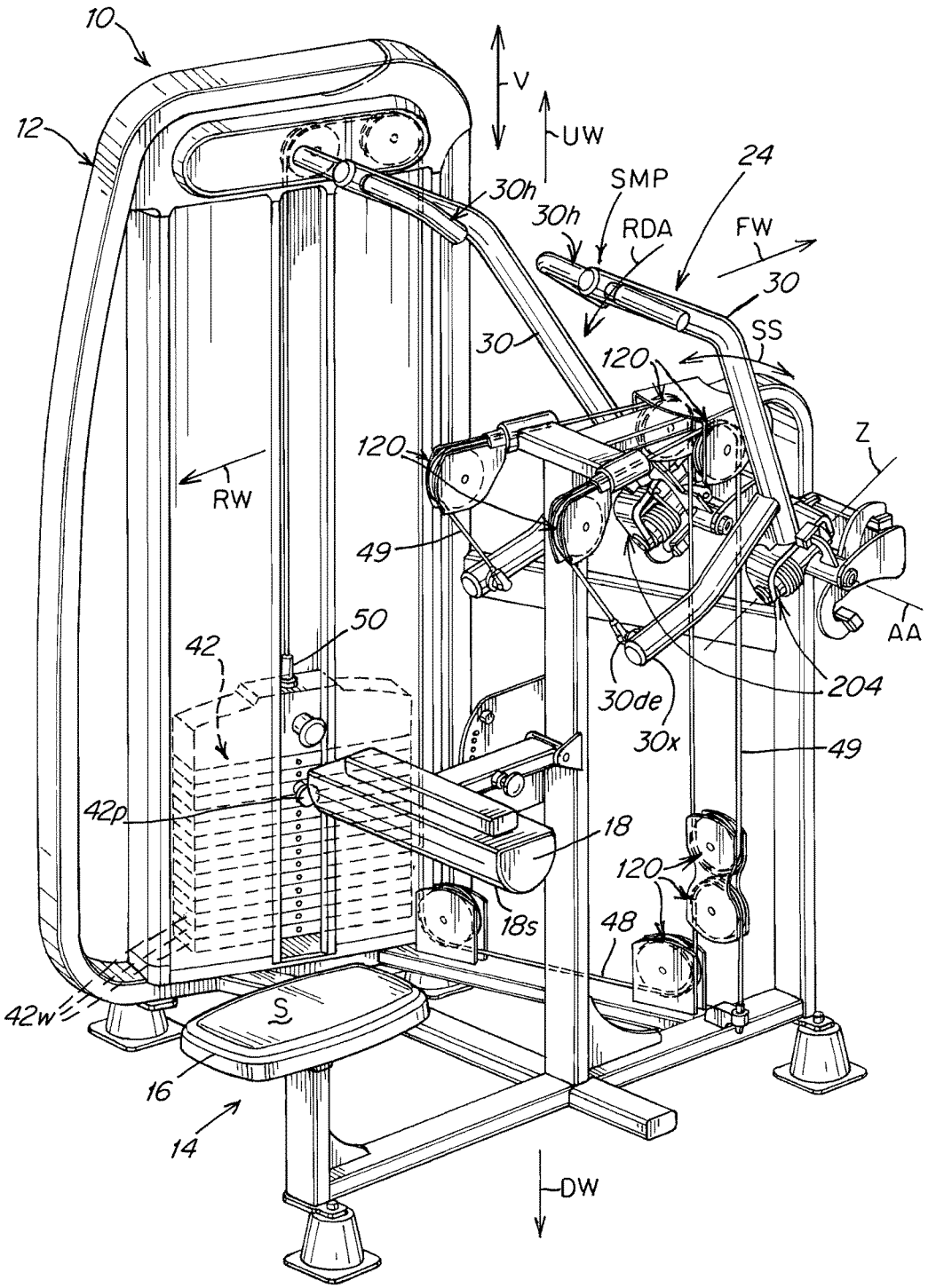
FIG. 1 is a right front perspective view of a pull down exercise apparatus according to the invention.
Figure 2:
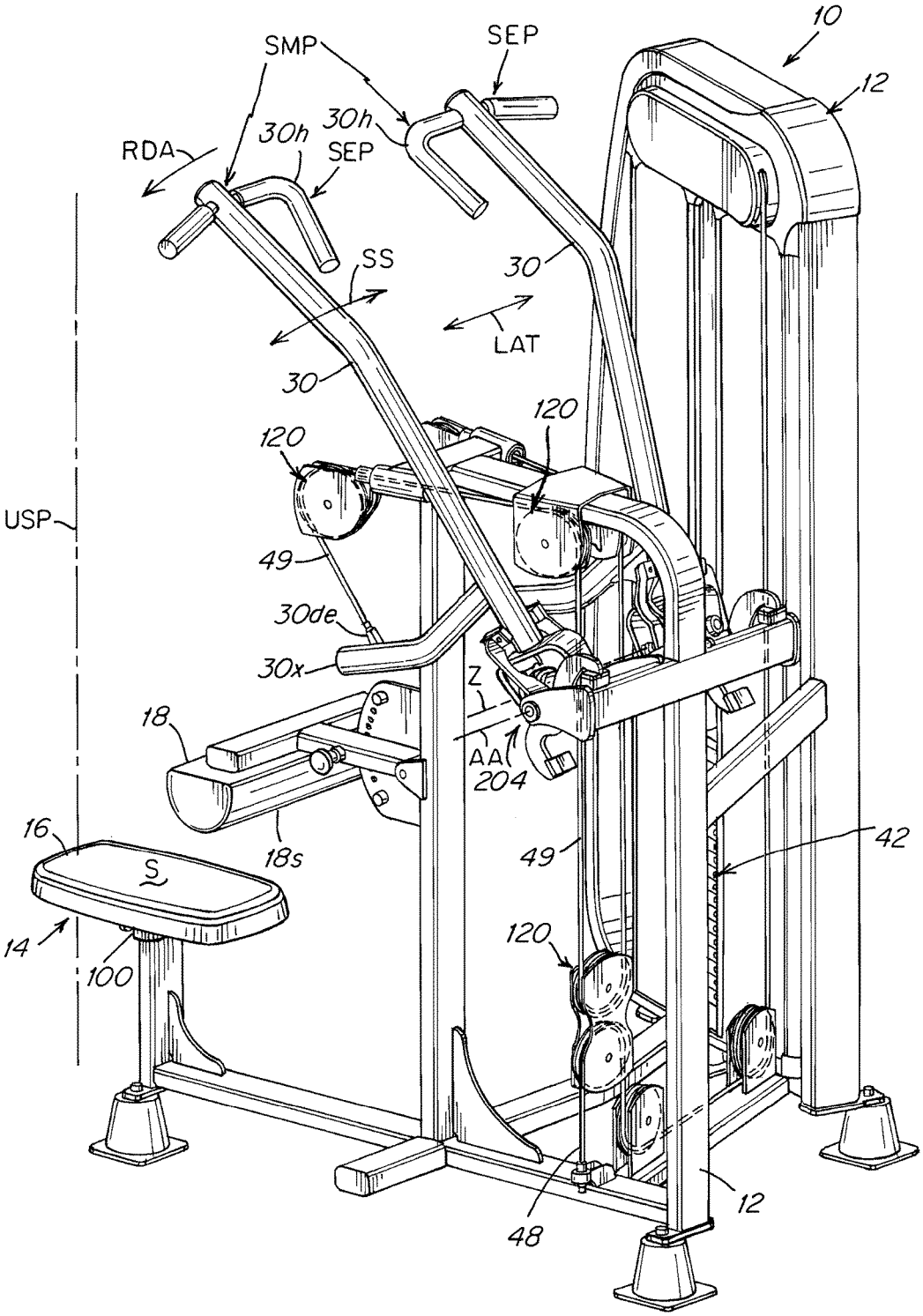
FIG. 2. is a rear right side perspective view of the FIG. 1 machine.

In an exemplary embodiment, as shown in FIG. 1, a pull down machine 10 of the present invention includes a support frame 12 on which a user support structure 14 is mounted. The user support structure 14 includes a seat 16 having a surface S and a stabilization engagement pad 18. The seat 16 is mounted on the frame 12 facing a pair of input arms 30 having handles 30*h* forwardly facing the user when seated on the seat 16.

The arms 30 are mounted to the frame, arranged, adapted and interconnected to a weight resistance such as a weight stack 42. The arms 30 are adapted and mounted to the support frame 12 for pivoting in an arcuate rotation about a generally horizontal axis AA. The arms 30 are rotatably pivotable about axis AA for arcuate generally forward (FW) to rearward (RW) and up (UW) and down (DW) movement by forcible pulling down (RDF) on the handles 30*h*.

Figure 3:
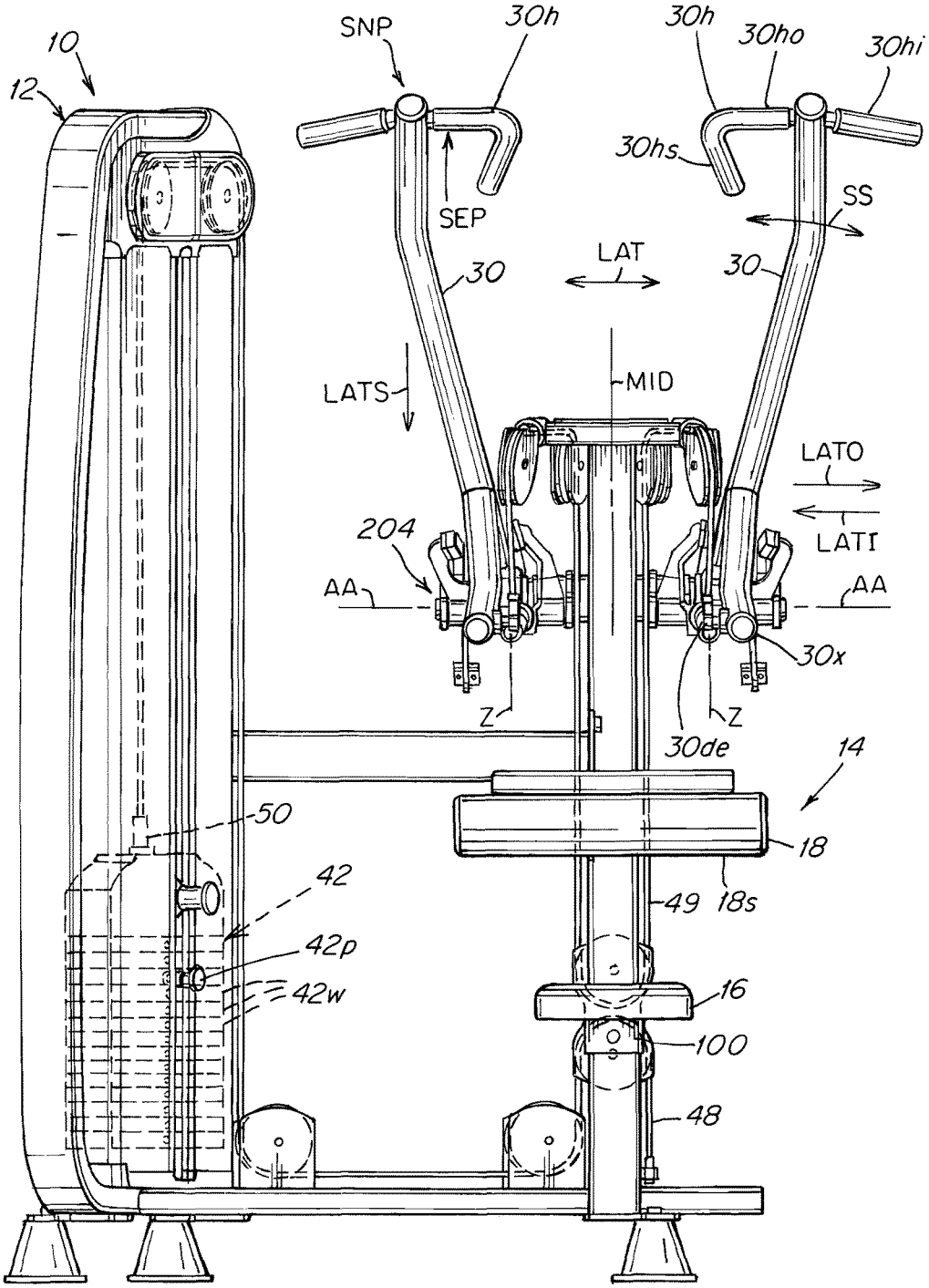
FIG. 3 is a front view of the FIG. 1 machine.

In the embodiment shown, the handles or manually graspable mechanism(s) 30*h*, FIGS. 5A, 5B, 6A, 6B, 7 are comprised of a first travel director 30*hi*, second travel director 30*hs* and third travel director 30*ho*. Each of the travel directors 30*hi*, 30*hs*, 30*ho* are fixedly attached to the distal end of arm 30 and each have a unique and different hand grip configuration that is selected to require the user's hands 17, arms 13 and trunk T1 to assume a unique and different posture when the user 5 applies a rearward downward force RDF to tend to travel along a predetermined different and unique lateral direction or path. Travel director 30*hi* is selectively configured to require the user 5 to assume an arm, hand and trunk posture such that the user's hand 17 is forced or biased to travel laterally inwardly LATI, FIG. 3, when the user pulls down and rearwardly RDF on the travel director 30*hi*. Travel director 30*ho* is selectively configured to require the user 5 to assume an arm, hand and trunk posture such that the user's hand 17 is forced or biased to travel laterally outwardly LATO when the user pulls down and rearwardly RDF on the handle travel director 30*ho*. Travel director 30*hs* is configured to require the user 5 to assume an arm, hand and trunk posture such that the user's hand 17 is forced or biased to travel laterally generally straight LATS or generally along a parallel plane that defines the lateral midline M of the apparatus 10 when the user pulls down and rearwardly RDF on the travel director 30*hs*.

Figure 5A:
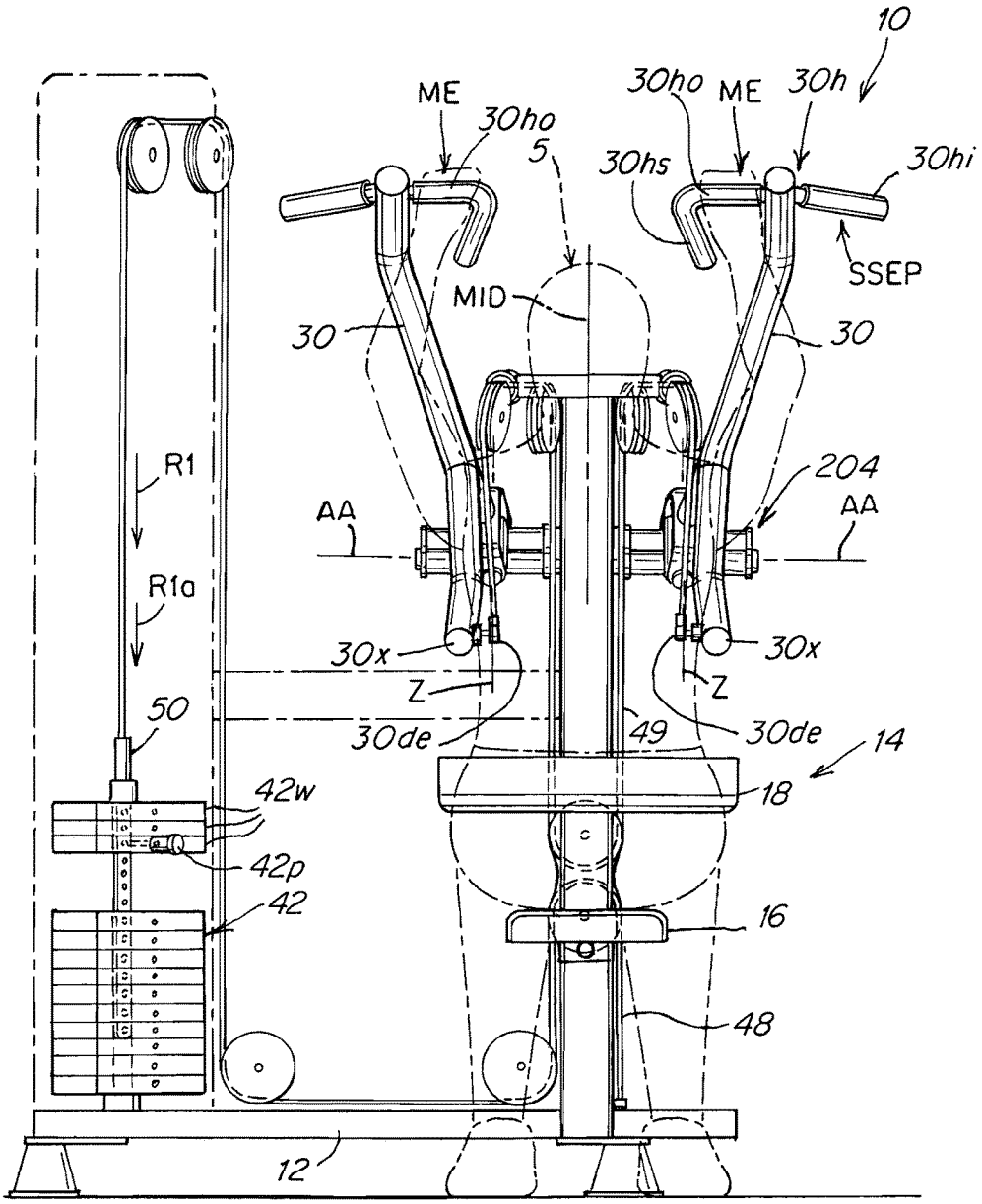
FIG. 5A is a schematic front view of the FIG. 1 machine showing a user seated in a sitting exercise position.
Figure 5B:
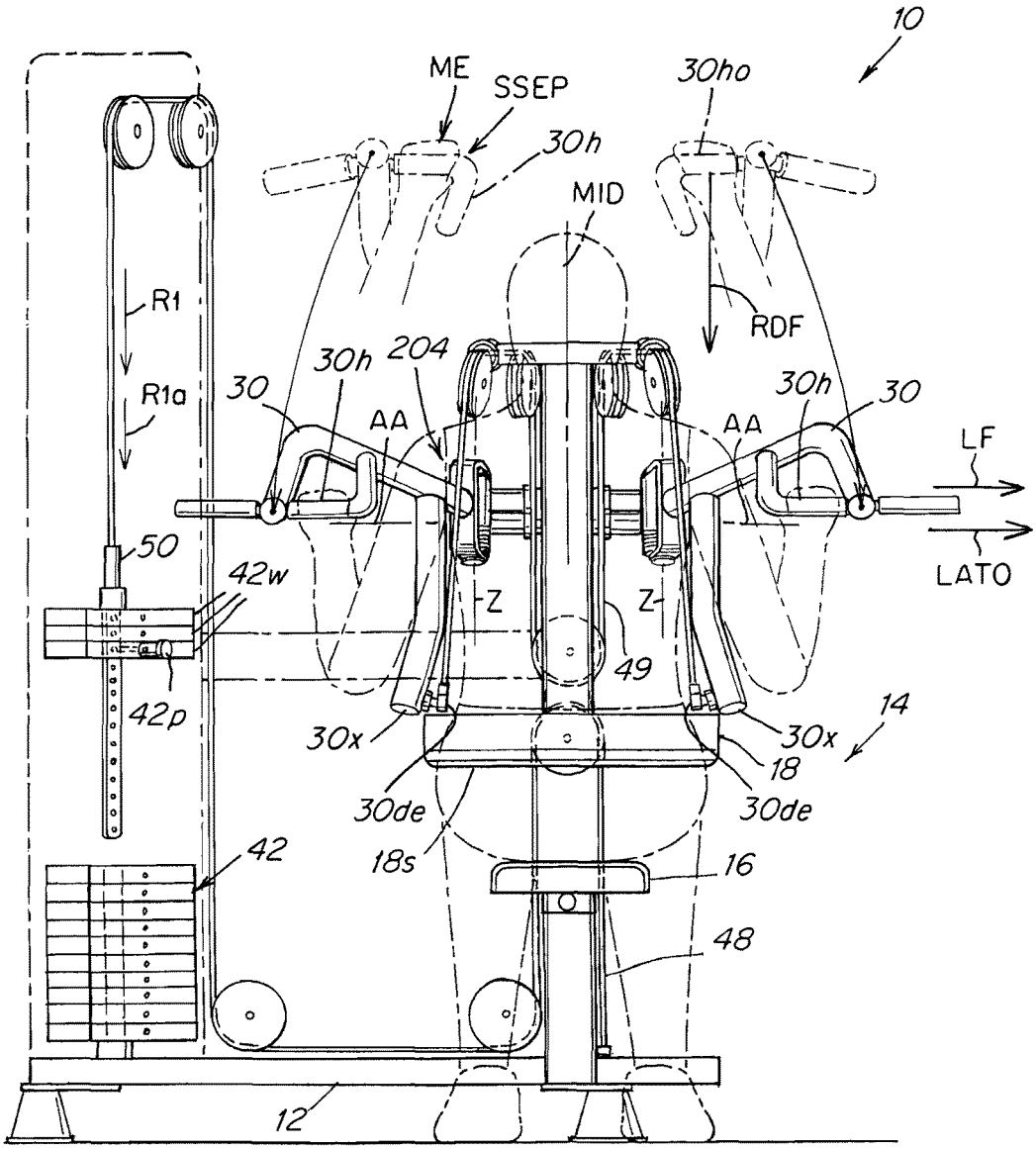
FIG. 5B is a schematic view similar to FIG. 5A showing the user's arms and the input arm assembly in a fully rearward and downward exercise position.

For example as shown in FIGS. 5A, 5B when the user is engaged in an exercise cycle with the user's hands engaging and gripping ME travel director 30*ho*, the user's arms, hands, shoulders and upper trunk are biased toward moving laterally outwardly LATO, FIG. 5 on pulling RDF the handle 30*h* rearwardly and downwardly RDF. In the process of the user's pulling rearwardly and downwardly RDF beginning from the start exercise position SEP of the hands 17, the user exerts a lateral force LF to overcome the opposing force R1*a* exerted by the weight stack 42. As described below, the weight stack 42 exerts the force R1*a* against the laterally outward movement LATO on account of the arrange of the point of interconnection of the distal arm 30*x* at the selected point 30*de* which is disposed a preselected orthogonal distance SOD from the axis of rotation Z of the arm 30 assembly 24.

As shown in FIGS. 5A-6B, the apparatus 10 has a start motionless position SMP where the arms 30*h* are stationarily disposed at a vertical position SEP above the user's trunk T1 when the user 5 is seated SP on the seat surface S in a generally upright position where the longitudinal axis of the user 5 is generally parallel to vertical V. The start motionless position is achieved by the arm 30 being either held or biased under a forwardly and upwardly directed force, typically through cables 48, 49 and weight stack 42, typically against the stop 160*u*, FIG. 7, such that the arm is maintained in the stationary SMP position when not subject to a force exerted on the arms 30.

Figure 4:
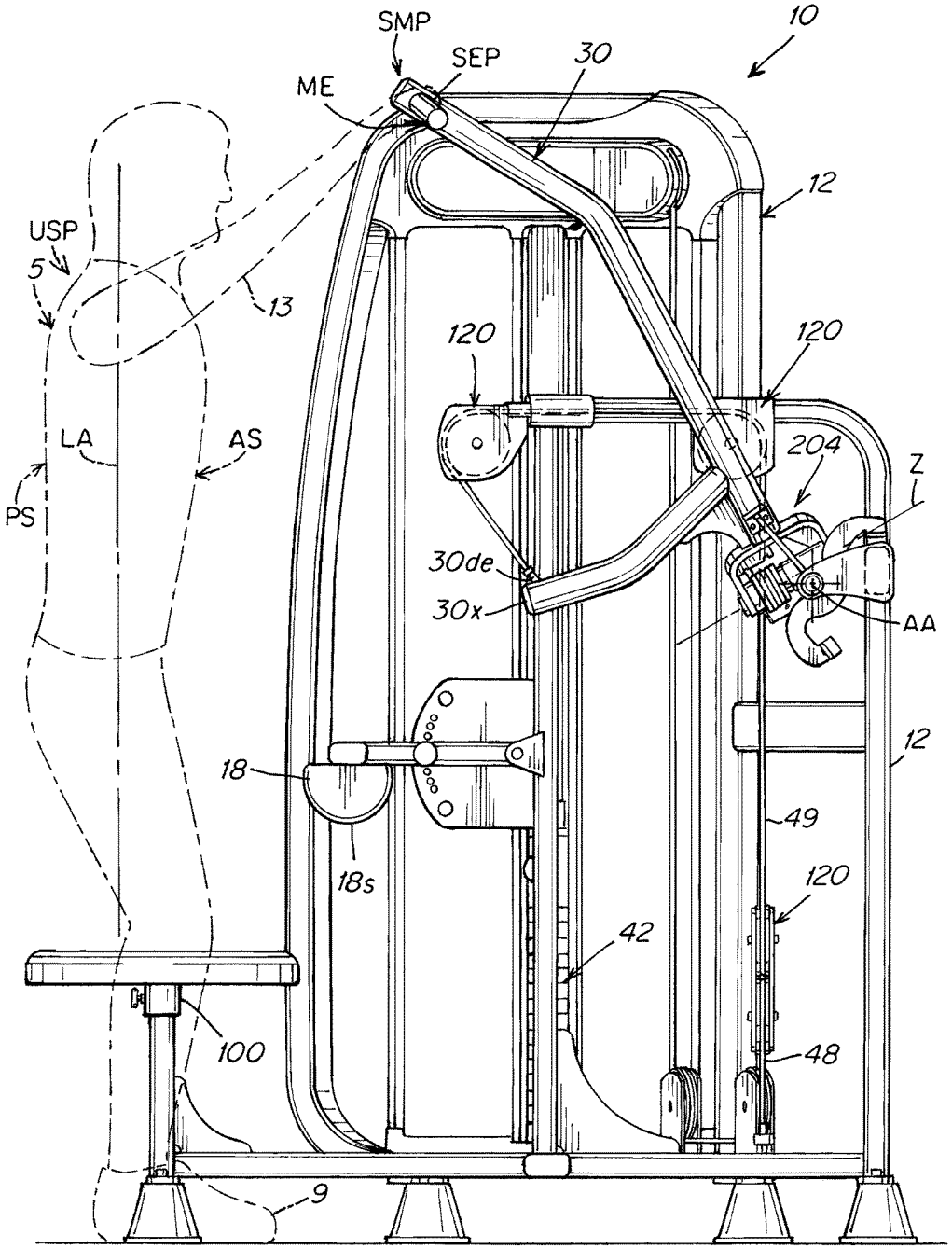
FIG. 4 is a right side view of the FIG. 1 machine.

At the start of an exercise cycle, the arm assembly 24 is in the start motionless position SMP and the user stands up in a user standing position USP in order to manually reach and engage ME a selected one of the travel directors 30*ho*, 30*hs*, 30*hi* of the handles 30*h* in the start exercise position SEP. The user 5 typically stands in the user standing position with the user's feet 9 and legs straddling the left and right sides of the seat 16 as shown in FIG. 4. The user 5 next begins to perform an exercise cycle by manually engaging or grabbing ME a selected one of the travel directors 30*ho*, 30*hs*, 30*hi* which are initially disposed in the start exercise position SEP. Next in continuing performance of an exercise cycle the user 5 exerts a generally rearwardly RW and downwardly DW directed force RDF on one or both handles 30 which causes the selected number of weight plates 42*w* to exert an opposing resistance force R1 against the user's force RDF. Once the user first starts exerting force RDF while in the standing position USP, the user then continues to exert rearwardly and downwardly force RDF and simultaneously squat until the user 5 has lowered the user's trunk T1 downwardly DW to a position where the user 5 is disposed in a sitting position SP on the seat surface S, FIGS. 5A-6B with the handles 30*h* being disposed in the start sitting exercise position SSEP, FIGS. 5A, 5B, 6A upon the user's assuming the sitting position SP.

Figure 6A:
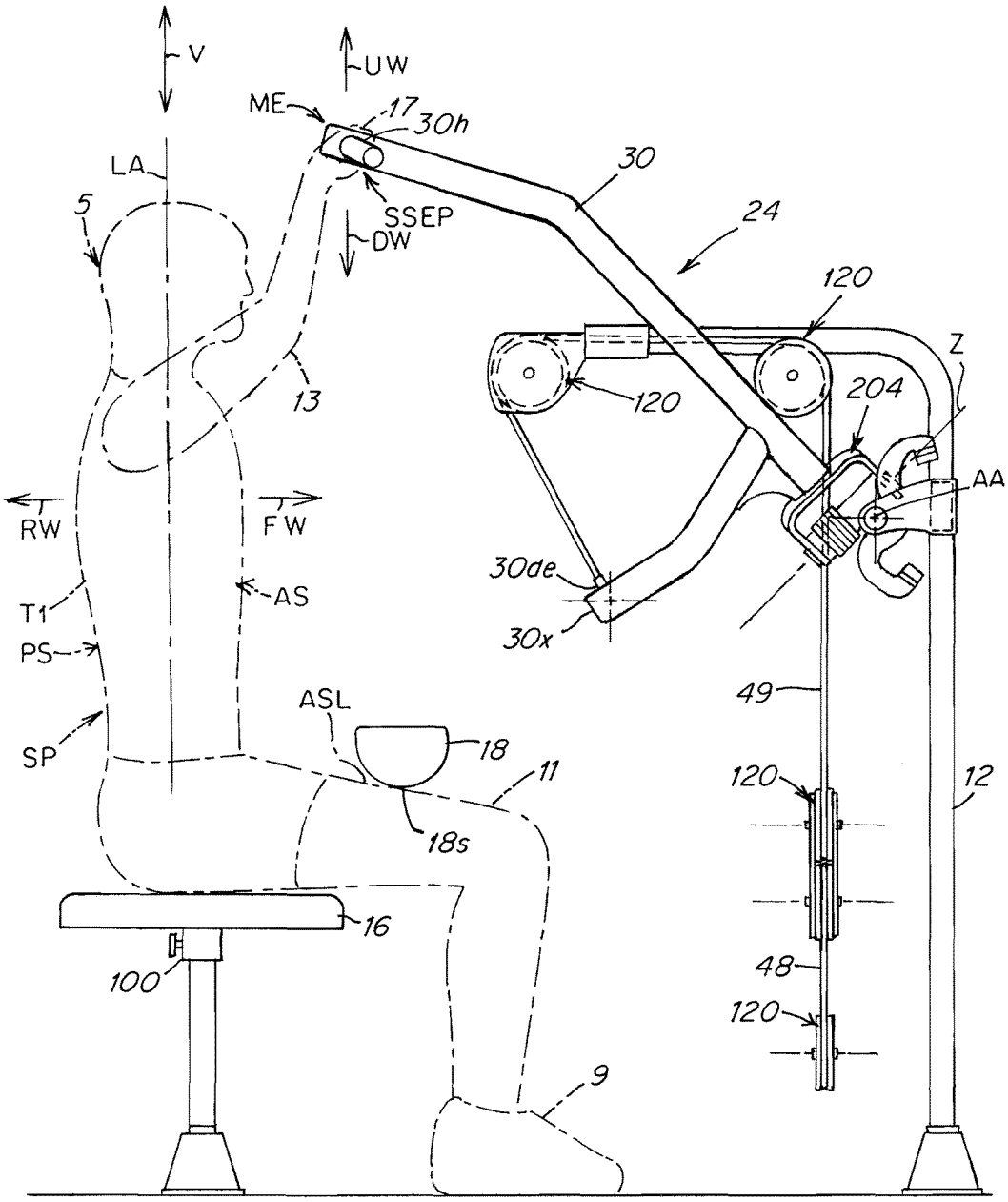
FIG. 6A is a schematic side view of the FIG. 5A user in a sitting exercise position.
Figure 6B:
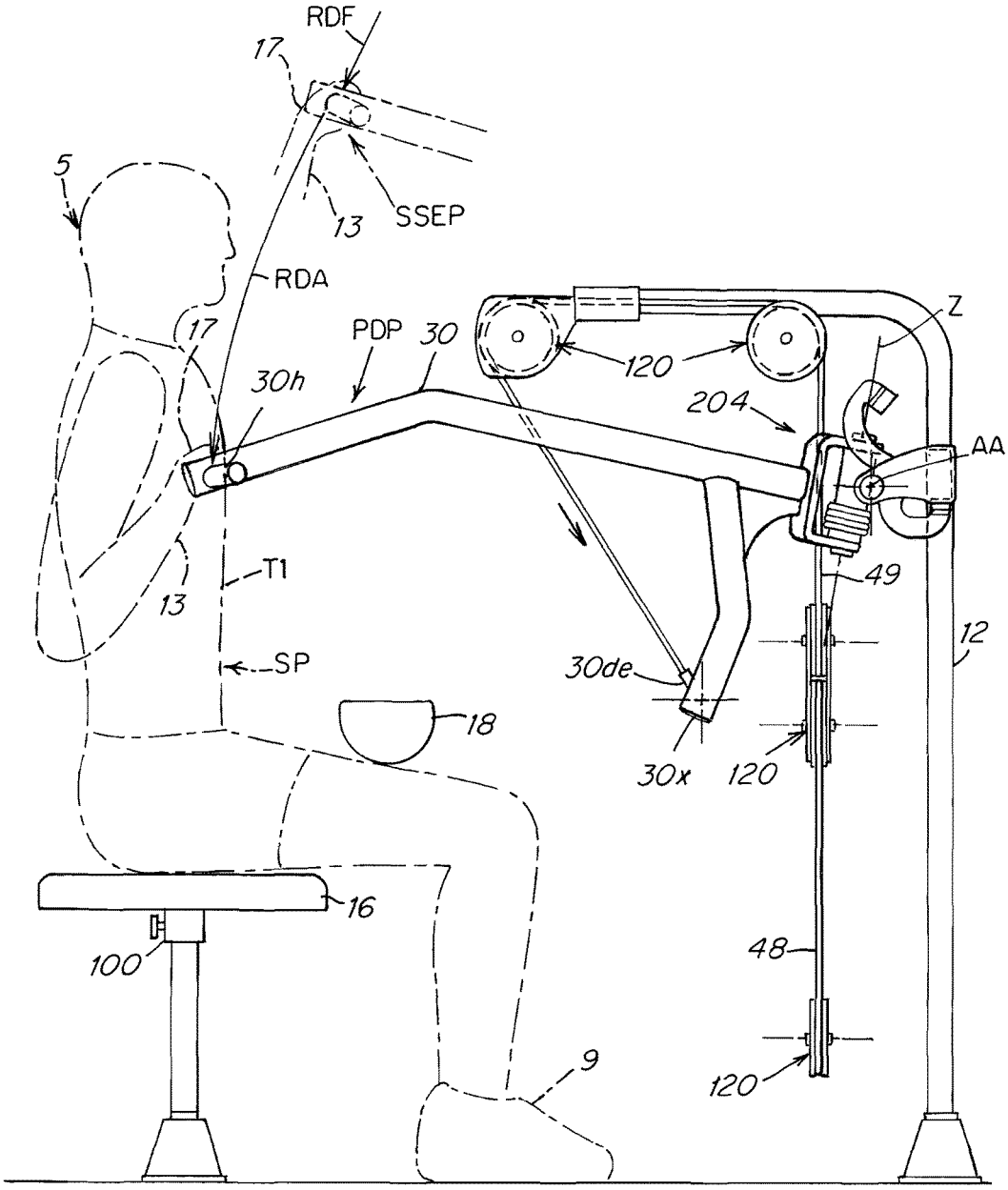
FIG. 6B is a side schematic view of the FIG. 6A user in a fully rearward and downward pull down exercise position.

Next the user 5 continues to exert downwardly and rearwardly directed force RDF until the arm 30 travels from the start sitting exercise position SSEP rearwardly and downwardly to the fully pulled down position PDP, FIG. 6B.

During the course of the user's pulling RDF on the handle 30*h* from the start exercise position SEP to the start sitting exercise position SSEP to the pull down position PDP, the arm 30 assembly rotates around axis AA with the cable 48, 49 pulling the weight stack 42 upwardly and exerting a resistance force R1 against the user's muscles which are performing the pulling RDF.

The weight stack 42 is selectively connected to one end of a cable 48 by inserting a pin 42*p* in one of a plurality of holes in a lifting post 50 that passes vertically through the plates, as is well known in the art. For example, the weight stack 42 is formed by a stack of rectangular, brick-shaped plates 42*w*. Each plate 42*w* further has at least one horizontal channel or hole, wherein a pin 42*p* may be disposed to slidably engage any of a series of horizontal channels which are vertically oriented on the lifting post 50 in a spaced apart manner to match the vertical spacing of the stacked weight plates 42*w*. The pin 42*p* thereby engages a portion of the stack of weight plates 42*w*, such that when vertical force is applied to the lifting post 50, the selected stack of weight plates 42 is moved upwards to create a resistance. Typically, the weight stack 42 apparatus is oriented such that the further down the pin is entered into the lifting post 50, the greater the number of plates 42*w* are engaged, thereby increasing the resistance of the machine.

As shown the weight stack is interconnected to the arm assembly 24, 30, 30*x* by a series of pulleys 120 and cables 48, 49 and can be interconnected by other known means such as belts, cables, chains, or tethers, so as to inhibit rotation thereof.

In alternative embodiments, other mechanisms for providing resistance, such as friction fittings, springs, elastic bands, pneumatic or electromagnetic resistance, or an air resistance fan could be employed (either alone or in combination) and still practice the invention. Additionally, free weights could be operably engaged to the transmission assembly to resist the movement.

In addition to being rotatable around horizontal axis AA the arms 30 are rotatable around the U-joint or gimbal-like second axis Z which in the embodiment shown is perpendicular to axis AA although other angular relationships could be used between axis AA and axis Z. The user can therefore pull RDF the arms 30 in both the back RW and forth FW arcuate direction RDA around axis AA as well as in the side-to-side SS or lateral LAT direction around axis Z.

Figure 7:
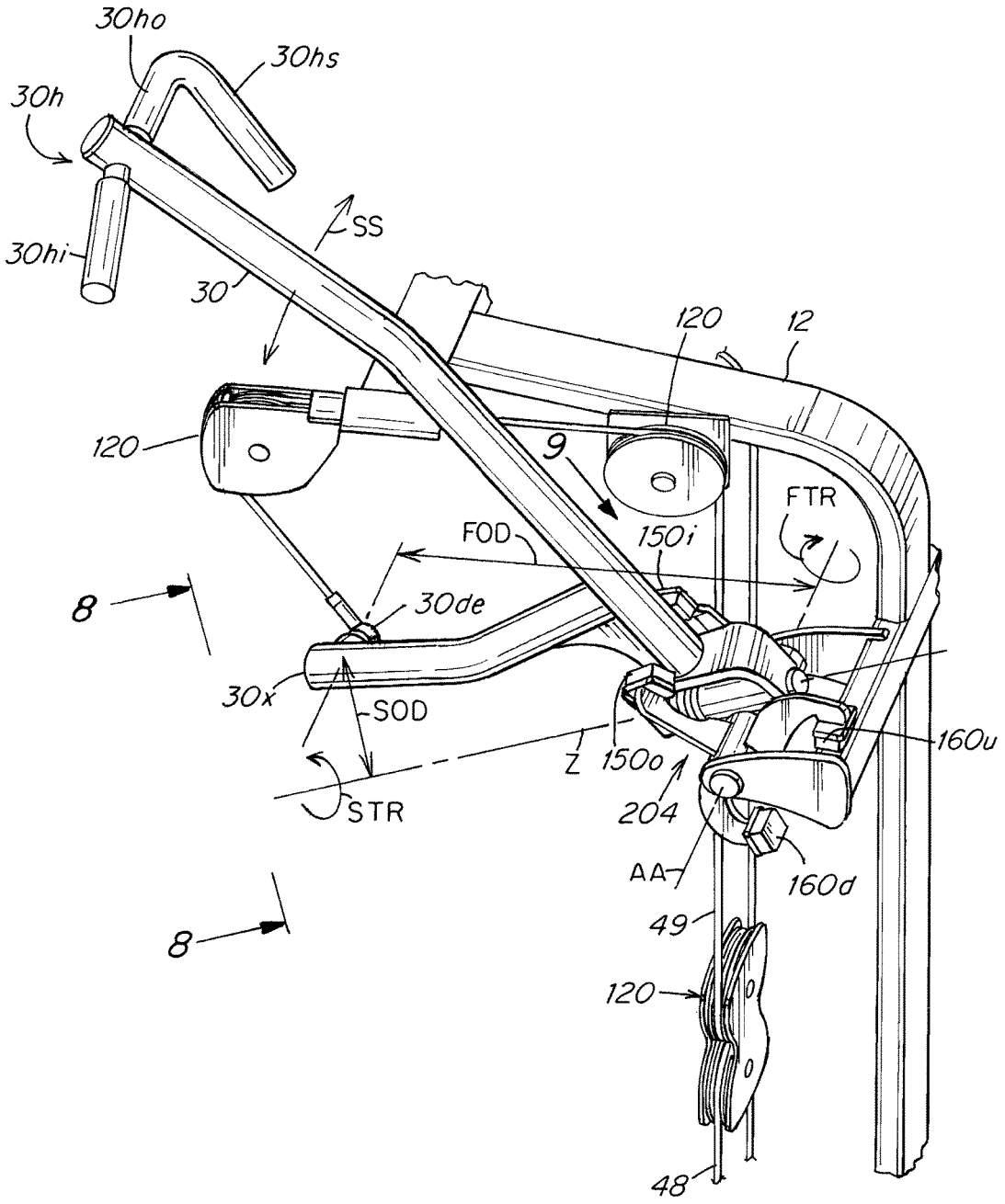
FIG. 7 is a front side perspective view of an input arm assembly of the FIG. 1 machine by itself.
Figure 8:
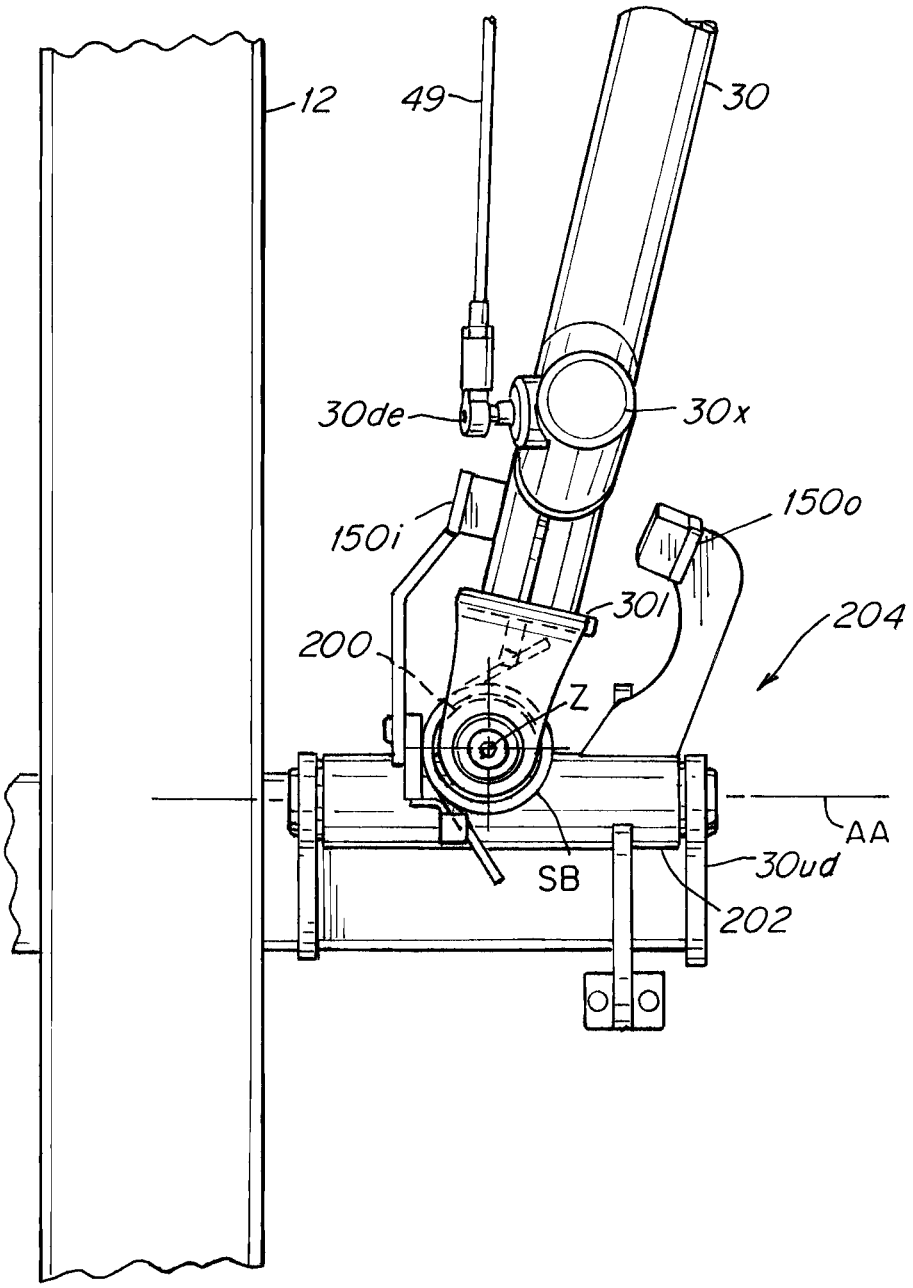
FIG. 8 is an enlarged fragmentary view of the gimbal or dual axle and bracket assembly along lines 8-8 of FIG. 7.
Figure 9:
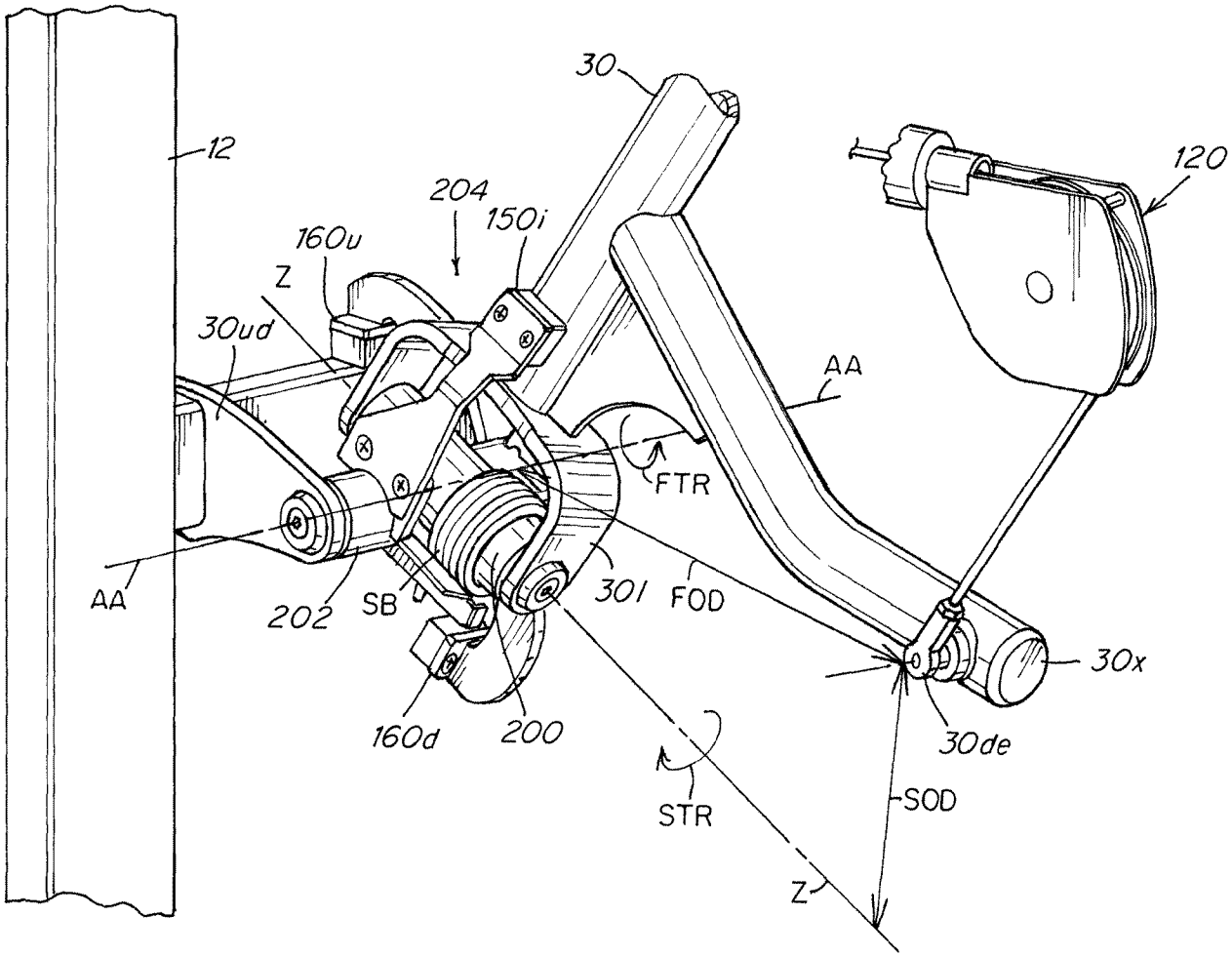
FIG. 9 is an enlarged fragmentary view of the gimbal or dual axis and bracket assembly along arrow 9 of FIG. 7.

In the embodiments shown, FIGS. 7, 8, the degree of side-to-side SS or lateral LAT travel or pivoting around axis Z of the arms 30 can be limited by stop mechanisms 150*i*, 150*o* which respectively limit laterally inward LATI and laterally outward LATO travel. Similarly, the degree of upward UW and forward FW pivoting of arm 30 around axis AA is limited by stop 160 and the degree of downward DW and rearward RW pivoting around axis AA is limited by stop 160*d*.

The arms 30 are interconnected via leverage arm 30*x* to the weight stack 42 via cable 49. Leverage arm 30*x* is fixedly attached at the base 30*b* of arm 30 near the pivot axis AA to provide ready leverage in pulling on the weight stack elements 42*w*. Cable 49 is connected to a distal point of connection 30*de* of the leverage arms 30*x*.

The point of interconnection 30*de* is selected to provide a resistance from resistance mechanism 42 to lateral LAT or side to side SS movement as well as resistance to rearward RW and downward DW movement of arm 30. Point of interconnection 30*de* is disposed an orthogonal distance FOD from axis AA and an orthogonal distance SOD from axis Z which together with a preselected configuration and arrangement of the arm assembly 24 and the cable 49 and other interconnections between point 30*de* of arm 30*x* and the weight resistance 42 to create a resistance against lateral LAT or SS movement as well as against rearward RW or downward DW movement of the handle 30 and arm assembly 24 beginning from the start motionless SMP position.

Figure 10:
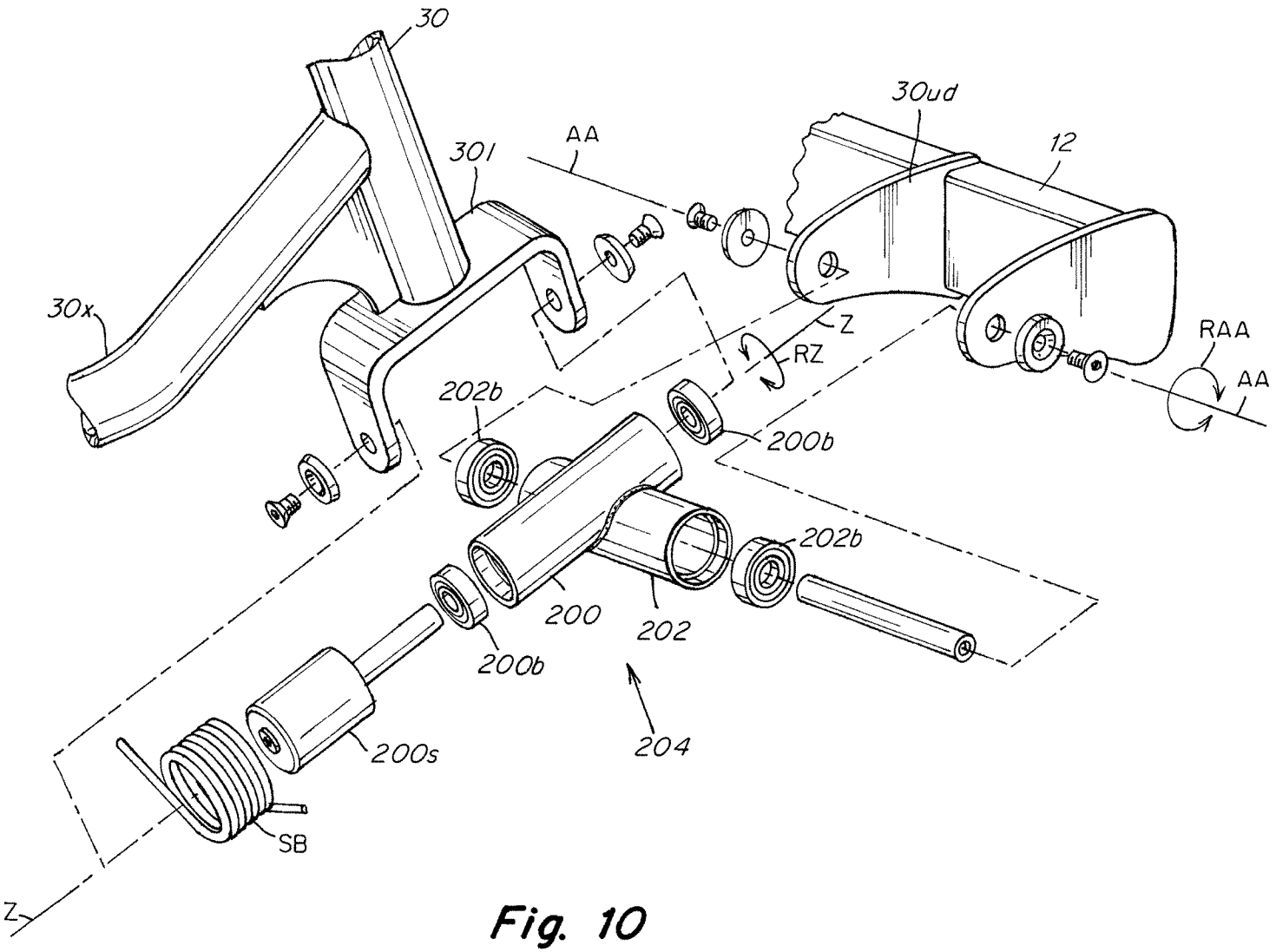
FIG. 10 is an enlarged exploded fragmentary view of the dual axle and bracket or gimbal assembly by which the input arm assembly of the FIG. 1 apparatus is mounted to the frame.

FIG. 10 shows an example of the structure of a dual axis joint or gimbal 204 by which the arms 30, 30*x* are mounted to the frame 12. The dual axis joint is comprised of a first axle 202 that is mounted via bearings 202*b* to bracket 30*ud* for rotation RAA of arm 30 around the first axis A. The first axle 202 is fixedly attached to second axle 200 having ball bearings 200*b* mounted therein for enabling rotation RZ of arm 30 around axis Z. As shown arms 30, 30*x* are mounted to axle 200 and 202 via U shaped bracket 301. Thus arms 30, 30*x* are pivotable or rotatable around both axes AA and Z.

In the embodiment shown a stabilization spring mechanism SB is mounted around an axial spacer 200*s* within the U-shaped recess of U-shaped bracket 301 in an arrangement that biases arm 30 laterally inwardly LATI to assume the start motionless position SMP when the arms 30 are not subject to an external force such as RDF.

The stabilization pad 18 is fixedly mounted and arranged relative to the seat 16 such that when the user 5 exerts a force RDF on the apparatus 10, the user's torso T1 is prevented from moving in an upward UW direction as a result of engagement of the anterior surface ASL of the user's legs 11 with a downwardly facing user leg engagement surface 18*s* of the pad 18. The seat 16 and seat surface S are typically selectively adjustable to a selected vertical height or position via vertical height adjuster 100 such that the start exercise position of the anterior surface ASL of the user's legs 11 can be closely positioned in close adjacency or in engagement with the undersurface 18*s* of the pad 18.

What is claimed is:

1. Apparatus for performing a pull down exercise by a user having a trunk (T1) having a longitudinal axis (LA), opposing anterior (AS) and posterior (PS) sides, the user having arms extending from the trunk, the apparatus comprising:

a frame, a seat having a seating surface (S), an input arm assembly interconnected to a resistance mechanism (42) and a manually graspable mechanism, the input arm assembly being pivotably (AA, Z) mounted on the frame for back and forth travel along a generally forward (FW) to rearward (RW) direction, the input arm assembly being adapted to reside in a start motionless position (SMP) that disposes the manually graspable mechanism in a start exercise position (SEP) that is disposed vertically (V) above the user's trunk (T1) when the user is seated on the seating surface (S) in an orientation where the longitudinal axis (LA) of the user's trunk (T1) is disposed generally upright (V), the input arm assembly being rotatably pivotable (RDA) around a first linear axis (AA) starting from the start motionless position (SMP) through a generally rearward (RW) and downward (DW) path of travel on application of rearwardly or downwardly directed force (RDF) by the user on the manually graspable mechanism, the input arm assembly being rotatably pivotable (SS) around a second linear axis (Z) through a generally lateral (LAT) or side to side path of travel on application of generally laterally directed force (LF) by the user on the manually graspable mechanism starting from the start exercise position (SEP), the input arm assembly being interconnected to the resistance mechanism (42) at a point of interconnection (30*de*) of the input arm assembly that is spaced a first selected orthogonal distance (FOD) apart from the first linear axis (AA) selected to create a first selected torque resistance (FTR) from the resistance mechanism when the input arm assembly is pivoted away from the start motionless position (SMP) around the first axis (AA) and a second selected orthogonal distance (SOD) from the second linear axis (Z) selected to create a second selected torque resistance (STR) from the resistance mechanism when the input arm assembly is pivoted away from the start motionless position (SMP) around the second axis (Z).

2. The apparatus of claim 1 wherein the input arm assembly comprises an arm (30) having a leverage arm (30*x*) fixedly attached and projecting from a base (30*b*) of the arm (30) disposed near the first linear axis (AA), the resistance mechanism being interconnected to a distal end (30*de*) of the leverage arm (30*x*), the arm (30) and the leverage arm (30*x*) being rotatably pivotable (RDA) around a first linear axis (AA) starting from the start motionless position (SMP) through a generally rearward (RW) and downward (DW) path of travel under resistance (R1) exerted by the resistance mechanism on application of rearwardly or downwardly directed force (RDF) by the user on the manually graspable mechanism.

3. The apparatus of claim 1 wherein the seat and the input arm assembly are arranged and adapted to enable the user in a user standing position (USP) to manually engage (ME) the manually graspable mechanism with the input arm assembly in the start motionless position (SMP) and to manually pull (RDF) the manually graspable mechanism (30*h*) downwardly (DW) under user exerted force (RDF) to a start sitting exercise position (SSEP) where the user is sitting in a seated position (SP) on the seat surface (S) and manually engaging (ME) the manually graspable mechanism.

4. The apparatus of claim 2 wherein the first selected orthogonal distance is greater than the second selected orthogonal distance.

5. The apparatus of claim 2 wherein the first selected orthogonal distance is greater than or equal to about 9 inches and the second selected orthogonal distance is greater than or equal to about 3 inches.

6. The apparatus of claim 1 wherein the first linear axis and second linear axis are disposed generally orthogonal relative to each other directing the input arm assembly to travel in generally orthogonal front to rear and side to side directions on pivoting of the input arm assembly around the first and second linear axes.

7. The apparatus of claim 1 wherein the input arm assembly is interconnected to the resistance mechanism via a cable that is interconnected at a proximal end to a point of interconnection of the input arm assembly that is spaced a first selected orthogonal distance apart from the first linear axis selected to create a first selected torque resistance from the resistance mechanism and a second selected orthogonal distance from the second linear axis selected to create a second selected torque resistance from the resistance mechanism wherein a distal end of the cable is interconnected to the resistance mechanism.

8. The apparatus of claim 1 wherein the manually graspable mechanism includes at least two travel directors that are each separately manually graspable by the user in a physical posture that is unique to each travel director, each travel director being interconnected to the input arm assembly in an arrangement that directs side to side or lateral travel of the manually graspable mechanism on application of rearwardly or downwardly directed force by the user along a lateral path of travel that is different for and unique to each travel director.

9. The apparatus of claim 8 wherein the manually graspable mechanism includes two or more of a first travel director that directs lateral travel of the manually graspable mechanism along a lateral path of travel laterally outwardly away from a midline (MID) of the apparatus, a second travel director that directs lateral travel of the manually graspable mechanism along a lateral path of travel generally parallel to the midline (MID) and a third travel director that directs the manually graspable mechanism along a lateral path of travel laterally inwardly toward the midline (MID).

10. The apparatus of claim 1 wherein the resistance mechanism comprises a selectable fixed weight device or a device that increases degree of resistance against the user's application of force on increase in pivotable movement of the input arm assembly rearwardly away from the start motionless position.

11. The apparatus of claim 1 wherein the user has legs extending from the user's trunk, the apparatus further comprising a stabilization pad mounted in a fixed position relative to the seat that is adapted to engage an anterior surface of the user's legs when the user is seated on the seat in an orientation where the longitudinal axis of the user's trunk is disposed generally upright and the anterior side (AS) of the user's trunk (T1) is facing in the forward direction (FW).

12. The apparatus of claim 1 wherein the arm is interconnected to a first axle that pivots about the first linear axis, the first axle being fixedly interconnected to a second axle that enables rotation of the arm about the second linear axis, the first axle and the second axle being rotatable around the first linear axis (AA).

13. The apparatus of claim 12 wherein the first axle is adapted to rotate around the first linear axis and the second axle is non-rotatable around the second linear axis, the first and second axles being pivotably mounted to first and second brackets forming a gimbal assembly.

14. A method of performing a pull down exercise comprising:

a user being seated on the seat of the exercise apparatus of claim 1 in a disposition where the longitudinal axis of the user's trunk is disposed generally upright and the anterior and posterior sides of the user's trunk are oriented generally in the forward to rearward direction, the user manually engaging the manually graspable mechanism of the apparatus of claim 1, and the user applying a rearwardly or downwardly directed force on the manually graspable mechanism against resistance from the resistance mechanism.

15. A method of performing a pull down exercise comprising:

a user being seated on the seat of the exercise apparatus of claim 1 in a disposition where the longitudinal axis of the user's trunk is disposed generally upright and the anterior and posterior sides of the user's trunk are oriented generally in the forward to rearward direction, the user manually engaging the manually graspable mechanism of the apparatus of claim 1, and the user applying a laterally or side to side directed force on the manually graspable mechanism against resistance from the resistance mechanism.

16. Apparatus for performing a pull down exercise by a user having a trunk having a longitudinal axis, opposing anterior and posterior sides and arms extending from the trunk, the apparatus comprising:

a frame, a seat having a seating surface (S), an input arm assembly interconnected to a resistance mechanism and a manually graspable mechanism, the input arm assembly being pivotably mounted on the frame around a first linear axis (AA) for back and forth travel along a generally forward to rearward direction, the input arm assembly being adapted to reside in a start motionless position (SMP) that disposes the manually graspable mechanism in a start exercise position (SEP) that is disposed vertically above the user's trunk (T1) when the user is seated (SP) on the seating surface (S) where the longitudinal axis (LA) of the user's trunk is disposed generally upright (V), the input arm assembly being rotatably pivotable around a second linear axis (Z) through a generally lateral or side to side (SS) path of travel under resistance (R1*a*) from the resistance mechanism, the input arm assembly being interconnected to the resistance mechanism at a distal end (30*de*) that is spaced a first selected orthogonal distance (FOD) apart from the first linear axis (AA) selected to create a first selected torque resistance from the resistance mechanism on pivoting of the input arm assembly around the first linear axis, the distal end (30*de*) being spaced a second selected orthogonal distance (SOD) from the second linear axis selected to create a second selected torque resistance from the resistance mechanism on pivoting of the input arm assembly around the second linear axis (Z).

17. The apparatus of claim 16 wherein the input arm assembly is interconnected to a first axle that pivots about the first linear axis, the first axle being fixedly interconnected to a second axle that enables rotation of the arm about the second linear axis, the first axle and the second axle being rotatable around the first linear axis (AA).

18. The apparatus of claim 16 wherein the first selected orthogonal distance is greater than the second selected orthogonal distance.

19. The apparatus of claim 16 wherein the input arm assembly comprises an arm (30) having a leverage arm (30*x*) fixedly attached and projecting from a base (30*b*) of the arm (30) disposed near the first linear axis (AA), the distal end (30*de*) being disposed on the leverage arm (30*x*), the arm (30) and the leverage arm (30*x*) being rotatably pivotable (RDA) around a first linear axis (AA) starting from the start motionless position (SMP) through a generally rearward (RW) and downward (DW) path of travel under resistance (R1) exerted by the resistance mechanism on application of rearwardly or downwardly directed force (RDF) by the user on the manually graspable mechanism.

20. The apparatus of claim 16 wherein the first linear axis and second linear axis are disposed generally orthogonal relative to each other.

21. The apparatus of claim 16 wherein the input arm assembly is interconnected to the resistance mechanism via a cable that is interconnected at a proximal end to a point of interconnection of the input arm assembly that is spaced a first selected orthogonal distance apart from the first linear axis selected to create a first selected torque resistance from the resistance mechanism and a second selected orthogonal distance from the second linear axis selected to create a second selected torque resistance from the resistance mechanism wherein a distal end of the cable is interconnected to the resistance mechanism.

* * * * *